US009947458B2

(12) United States Patent
Igarashi

(10) Patent No.: US 9,947,458 B2
(45) Date of Patent: Apr. 17, 2018

(54) COIL COMPONENT

(71) Applicant: MURATA MANUFACTURING CO., LTD., Kyoto-fu (JP)

(72) Inventor: Akio Igarashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 167 days.

(21) Appl. No.: 14/963,755

(22) Filed: Dec. 9, 2015

(65) Prior Publication Data

US 2016/0086725 A1 Mar. 24, 2016

Related U.S. Application Data

(63) Continuation of application No. PCT/JP2014/067047, filed on Jun. 26, 2014.

(30) Foreign Application Priority Data

Jul. 8, 2013 (JP) ..... 2013-142350

(51) Int. Cl.
*H01F 27/29* (2006.01)
*H01F 27/28* (2006.01)
(Continued)

(52) U.S. Cl.
CPC ..... *H01F 27/2823* (2013.01); *H01F 3/12* (2013.01); *H01F 17/045* (2013.01); *H01F 27/04* (2013.01); *H01F 27/255* (2013.01); *H01F 27/2828* (2013.01); *H01F 27/29* (2013.01); *H01F 27/292* (2013.01); *H01F 17/043* (2013.01); *H01F 2017/0093* (2013.01); *H01F 2017/046* (2013.01)

(58) Field of Classification Search
CPC ..... H01F 5/00; H01F 27/00–27/36
USPC ..... 336/65, 83, 192, 196, 200, 232
See application file for complete search history.

(56) References Cited

U.S. PATENT DOCUMENTS 5,422,619 A * 6/1995 Yamaguchi ..... H01F 17/04 336/181
5,977,853 A 11/1999 Ooi et al.
(Continued)

FOREIGN PATENT DOCUMENTS

CN 102105953 A 6/2011
JP H06-215948 A 8/1994
(Continued)

OTHER PUBLICATIONS

International Search Report—PCT/JP2014/067047 dated Sep. 30, 2014.
(Continued)

*Primary Examiner* — Tuyen Nguyen
(74) *Attorney, Agent, or Firm* — Studebaker & Brackett PC

(57) ABSTRACT

A coil component includes two or more coils configuring a common mode choke coil and functions as an inductor against a normal mode AC current. A coil component includes a pot-type core formed in a box-like shape, a flat plate core, coils, and a partition core formed of a magnetic substance. The coils are accommodated inside the pot-type core and form a common mode choke coil by making the central axes thereof substantially match each other. Further, each of end portions of the coils function as outer electrodes. The partition core is provided between the coils.

15 Claims, 14 Drawing Sheets

(51) Int. Cl.

| | |
|---|---|
| ***H01F 17/04*** | (2006.01) |
| ***H01F 27/04*** | (2006.01) |
| ***H01F 27/255*** | (2006.01) |
| ***H01F 3/12*** | (2006.01) |
| *H01F 17/00* | (2006.01) |

(56) References Cited

U.S. PATENT DOCUMENTS

| | | | | |
|---|---|---|---|---|
| 5,999,066 | A | 12/1999 | Saito et al. | |
| 8,354,910 | B2 * | 1/2013 | Park | H01F 37/00 336/182 |
| 2002/0021201 | A1 | 2/2002 | Ol | |
| 2006/0158814 | A1 * | 7/2006 | Wasaki | H03H 7/09 361/118 |
| 2010/0013587 | A1 | 1/2010 | Yan et al. | |
| 2010/0085139 | A1 | 4/2010 | Yan et al. | |

FOREIGN PATENT DOCUMENTS

| | | | |
|---|---|---|---|
| JP | H07-320940 | A | 12/1995 |
| JP | H08-213242 | A | 8/1996 |
| JP | H09-134827 | A | 5/1997 |
| JP | H09-139317 | A | 5/1997 |
| JP | H10-135864 | A | 5/1998 |
| JP | 2000-021655 | A | 1/2000 |
| JP | 2001-167948 | A | 6/2001 |
| JP | 2002-043142 | A | 2/2002 |
| JP | 2002-313642 | A | 10/2002 |
| JP | 2003-243228 | A | 8/2003 |
| JP | 2013-501376 | A | 1/2013 |

OTHER PUBLICATIONS

Written Opinion—PCT/JP2014/067047 dated Sep. 30, 2014.

An Office Action; "Notice of Reasons for Rejection," issued by the Japanese Patent Office dated May 2, 2017, which corresponds to Japanese Patent Application No. 2015-526248 and is related to U.S. Appl. No. 14/963,755; with English language translation.

* cited by examiner 1, 1A, 1B, 1C, 1D

COIL COMPONENT

CROSS REFERENCE TO RELATED APPLICATIONS

This application claims benefit of priority to Japanese Patent Application 2013-142350 filed Jul. 8, 2013, and to International Patent Application No. PCT/JP2014/067047 filed Jun. 26, 2014, the entire content of which is incorporated herein by reference.

TECHNICAL FIELD

The present disclosure relates to coil components, particularly a coil component that includes two or more coils configuring a common mode choke coil with its perimeter being covered by a box-like magnetic core.

BACKGROUND

As a common mode choke coil whose perimeter is covered by a box-like magnetic core, a common mode filter disclosed in Japanese Unexamined Patent Application Publication No. 2003-243228 is known, for example. This type of common mode filter includes a pot-type core which is a box-type magnetic body whose one side is an opening portion, a flat plate magnetic body configured to seal the opening portion, and two helical coils positioned inside the pot-type core. The two coils are wound so that the central axes thereof match each other, and conductive wires configuring the respective coils are so provided as to be alternately laminated on each other.

In the case where a common mode alternating-current (AC) current flows in the common mode filter disclosed in Japanese Unexamined Patent Application Publication No. 2003-243228, directions of magnetic fluxes generated by the current flowing through the two coils are the same. Therefore the generated magnetic fluxes strengthen each other; as a result, the common mode filter functions as an inductor. On the other hand, in the case where a normal mode AC current flows in the common mode filter, the directions of the magnetic fluxes generated by the current flowing through the two coils are opposite to each other. Therefore the generated magnetic fluxes cancel each other out; as a result, the common mode filter does not function as an inductor.

In general, power supply lines of electronic devices, motor devices, and the like include not only common mode noise components but also normal mode noise components. As such, there is a requirement for common mode filters to additionally have a function of reducing the normal mode noise. However, even if the common mode filter disclosed in Japanese Unexamined Patent Application Publication No. 2003-243228 is intended to function as an inductor against a normal mode AC current, the generated magnetic fluxes cancel each other out, as discussed above, so that it is difficult for the stated common mode filter to function as an inductor.

SUMMARY

Technical Problem

An object of the present disclosure is to provide a coil component that includes two or more coils configuring a common mode choke coil and functions as an inductor against a normal mode AC current.

Solution to Problem

A coil component according to an aspect of the present disclosure comprises a box-like structure, a first coil provided inside the structure, a second coil provided inside the structure at a position on one side relative to the first coil, and a partition plate formed of a magnetic substance that is provided between the first coil and the second coil.

In the stated coil component, the first coil and the second coil form a common mode choke coil by making a central axis of the first coil and a central axis of the second coil substantially match each other when viewed in a direction along the central axes thereof, and each of end portions of the first coil and end portions of the second coil function as outer electrodes.

In the case where a common mode AC current flows in the above-mentioned coil component, magnetic fluxes generated by the current flowing through the two coils strengthen each other, whereby the coil component functions as an inductor. Meanwhile, in the case where a normal mode AC current flows in the coil component, paths of the magnetic fluxes generated by the current flowing through the two coils are isolated from each other by the partition plate formed of the magnetic body that is provided between the two coils. With this, in the above coil component, although the directions of the magnetic fluxes generated by the normal mode current flowing through the two coils are opposite to each other, the magnetic fluxes will not cancel each other out because the paths of these magnetic fluxes are isolated. Accordingly, the above coil component also functions as an inductor against a normal mode AC current.

Advantageous Effects of Disclosure

According to the present disclosure, a coil component that includes two or more coils configuring a common mode choke coil can function as an inductor against a normal mode AC current.

DETAILED DESCRIPTION

General Configuration of First Embodiment

A coil component 1 according to a first embodiment will be described with reference to the drawings. Hereinafter, a direction parallel to central axes of coils 30 and 40 included in the coil component is defined as a z-axis direction, and directions extending along sides of a pot-type core 10 of the coil component 1, when viewed from above in the z-axis direction, are defined as an x-axis direction and a y-axis direction, respectively. Note that the x-axis, y-axis, and z-axis directions are orthogonal to one another. Further, in the following descriptions, an expression of "upper portion" refers to a portion on a positive side of the z-axis direction, and an expression of "lower portion" refers to a portion on a negative side of the z-axis direction.

Figure 1:
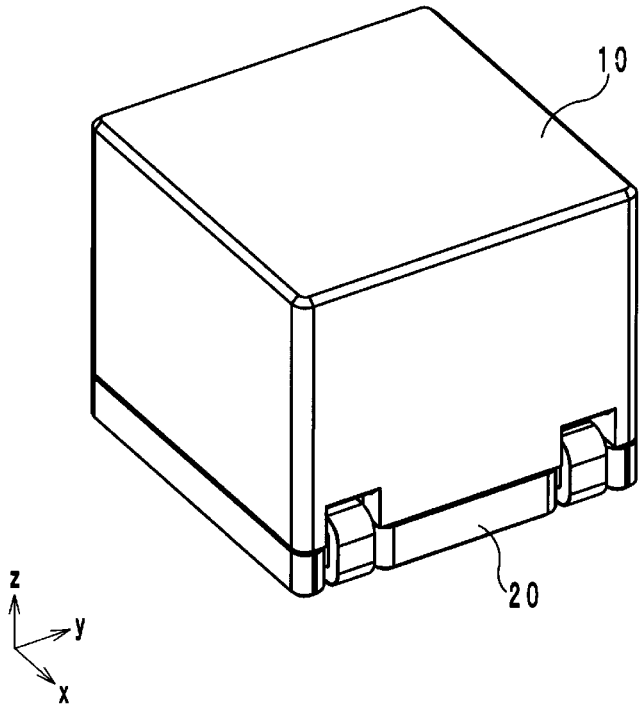
FIG. 1 is an exterior perspective view of a coil component according to a first embodiment.
Figure 2:
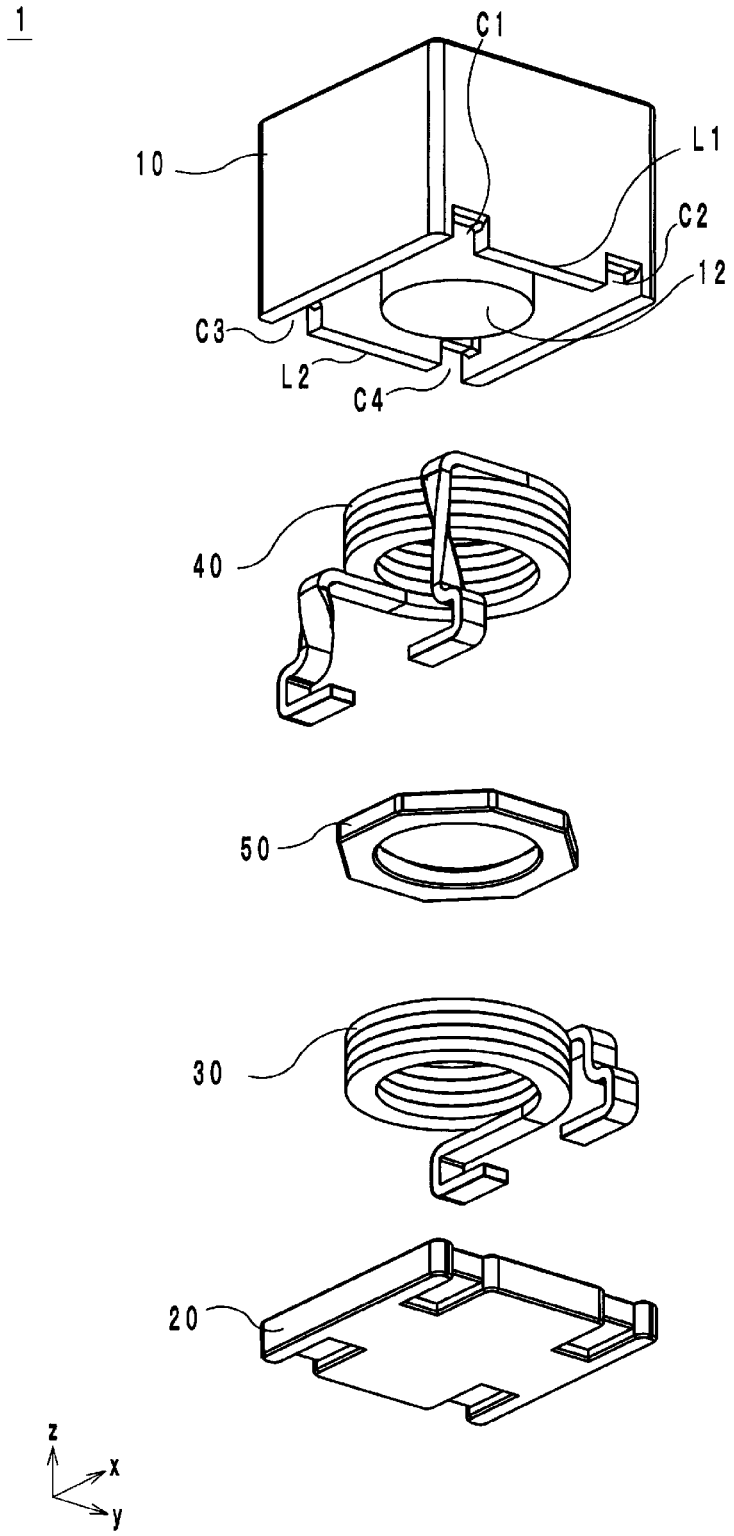
FIG. 2 is an exploded perspective view of the coil component according to the first embodiment.

As shown in FIG. 1, the coil component 1 has a rectangular parallelepiped shape as a whole. Further, the coil component 1 includes, as shown in FIG. 2, the pot-type core 10 (structure), a flat plate core 20 (structure), the coils 30 and 40, and a partition core 50 (partition plate).

Configurations of Pot-Type Core and Flat Plate Core

The pot-type core 10 and the flat plate core 20 are formed of magnetic material such as ferrite or the like and configure a housing in the coil component 1. The pot-type core 10 is formed in a box-type shape of a rectangular parallelepiped and has a core 12 that is formed in a circular cylinder extending along the z-axis direction in the pot-type core 10. Further, a side at a low portion of the pot-type core 10 is an opening portion.

Cutouts C1 and C2 each having a rectangular shape are provided in this order from a negative side to a positive side of the y-axis direction on both ends of a side L1 at a lower portion of a side surface positioned on a positive side of the x-axis direction in the pot-type core 10. Likewise, cutouts C3 and C4 each having a rectangular shape are also provided in this order from the negative side toward the positive side of the y-axis direction on both ends of a side L2 at a lower portion of a side surface positioned on a negative side of the x-axis direction in the pot-type core 10.

Figure 3:
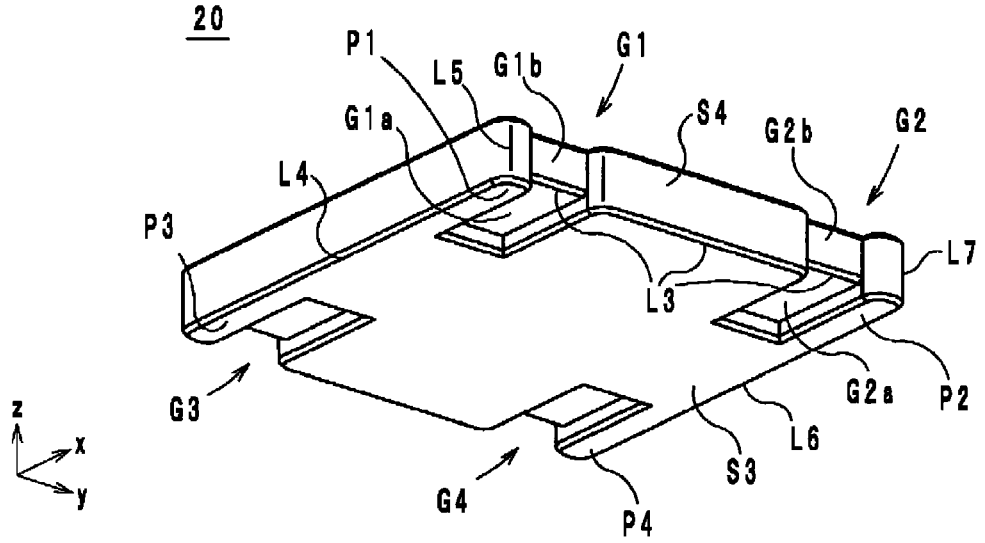
FIG. 3 is an exterior perspective view of a flat plate core in the coil component according to the first embodiment.

The flat plate core 20 is a square-shaped flat plate and covers the opening portion at the lower portion of the pot-type core 10. As shown in FIG. 3, recess portions G1 and G2 are provided extending across a surface S3 which is a principal surface at a lower portion of the flat plate core 20 and a surface S4 which is a side surface on the positive side of the x-axis direction of the flat plate core 20. In addition, as shown in FIG. 4, recess portions G3 and G4 are provided extending across the surface S3 and a surface S5 which is a side surface on the negative side of the x-axis direction of the flat plate core 20.

As shown in FIG. 3, the recess portion G1 is configured of a recess G1*a* provided at the surface S3 in parallel to the x-axis direction and a recess G1*b* provided at the surface S4 in parallel to the z-axis direction. The recess G1*a* is provided in the vicinity of a corner formed by a side L3 which is an edge of the side surface S3 at the positive side of the x-axis direction and a side L4 which is an edge of the surface S3 at the negative side of the y-axis direction. The recess G1*b* is provided in the vicinity of a corner formed by the side L3 which is an edge at a lower portion of the surface S4 and a side L5 which is an edge of the surface S4 at the negative side of the y-axis direction. Then, the recess G1*a* and the recess G1*b* are connected at the side L3 so as to form the recess portion G1 extending from the surface S3 to the surface S4.

The recess portion G2 is configured of a recess G2*a* provided at the surface S3 in parallel to the x-axis direction and a recess G2*b* provided at the surface S4 in parallel to the z-axis direction. The recess G2*a* is provided in the vicinity of a corner formed by the side L3 which is an edge of the surface S3 at the positive side of the x-axis direction and a side L6 which is an edge of the surface S3 at the positive side of the y-axis direction. The recess G2*b* is provided in the vicinity of a corner formed by the side L3 which is an edge at the lower portion of the surface S4 and a side L7 which is an edge of the surface S4 at the positive side of the y-axis direction. Then, the recess G2*a* and the recess G2*b* are connected at the side L3 so as to form the recess portion G2 extending from the surface S3 to the surface S4.

Figure 4:
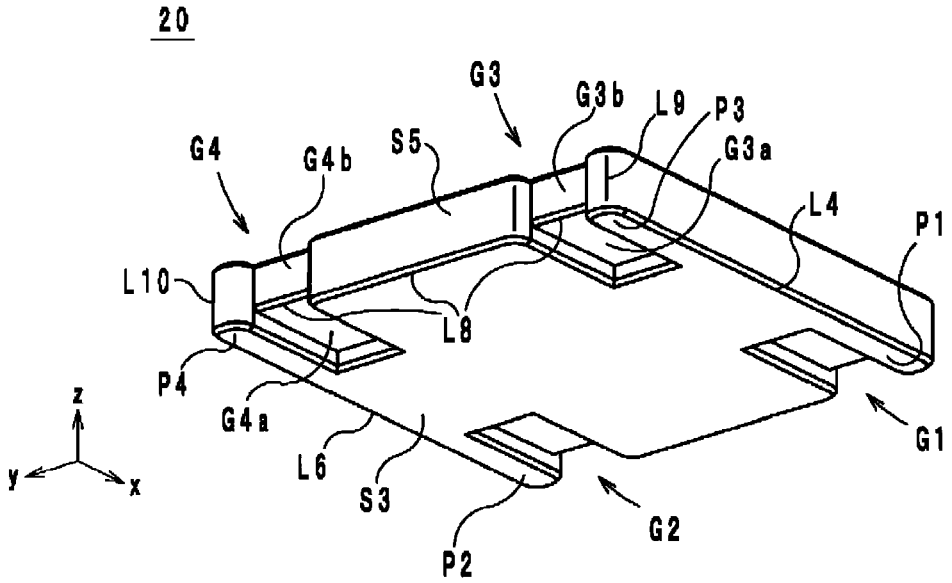
FIG. 4 is another exterior perspective view of the flat plate core in the coil component according to the first embodiment.

As shown in FIG. 4, the recess portion G3 is configured of a recess G3*a* provided at the surface S3 in parallel to the x-axis direction and a recess G3*b* provided at the surface S5 in parallel to the z-axis direction. The recess G3*a* is provided in the vicinity of a corner formed by a side L8 which is an edge of the surface S3 at the negative side of the x-axis direction and the side L4 which is an edge of the surface S3 at the negative side of the y-axis direction. The recess G3*b* is provided in the vicinity of a corner formed by the side L8 which is an edge at a lower portion of the surface S5 and a side L9 which is an edge of the surface S5 on the negative side of the y-axis direction. Then, the recess G3*a* and the recess G3*b* are connected at the side L8 so as to form the recess portion G3 extending from the surface S3 to the surface S5.

The recess portion G4 is configured of a recess G4*a* provided at the surface S3 in parallel to the x-axis direction and a recess G4*b* provided at the surface S5 in parallel to the z-axis direction. The recess G4*a* is provided in the vicinity of a corner formed by the side L8 which is an edge of the surface S3 at the negative side of the x-axis direction and the side L6 which is an edge of the surface S3 on the positive side of the y-axis direction. The recess G4*b* is provided in the vicinity of a corner formed by the side L8 which is an edge at the lower portion of the surface S5 and a side L10 which is an edge of the surface S5 at the positive side of the y-axis direction. Then, the recess G4*a* and the recess G4*b* are connected at the side L8 so as to form the recess portion G4 extending from the surface S3 to the surface S5.

Configuration of Coil

The coils 30 and 40 are linear conductors (conductive wires) provided inside the pot-type core 10 and made of conductive material such as Ag, Cu, or the like. Note that cross sections of the coils 20 and 30 are formed in a rectangle shape.

Figure 5:
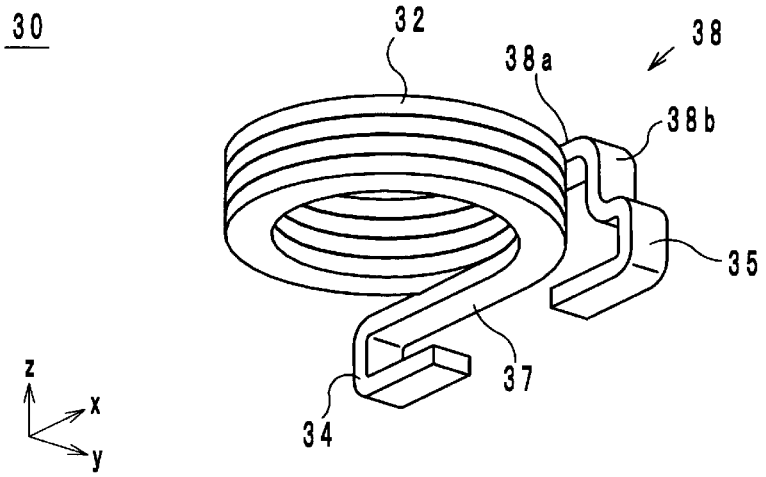
FIG. 5 is an exterior perspective view of a coil in the coil component according to the first embodiment.

The coil 30 (first coil) is positioned, as shown in FIG. 2, at a lower portion of the coil component 1, and configured of a winding section 32, outer electrodes 34 and 35, and connection portions 37 and 38, as shown in FIG. 5.

The winding section 32 is formed in a helical shape in a counterclockwise direction from an upper portion toward a lower portion thereof. The core 12 of the pot-type core 10 is accommodated at an inner circumference side of the winding section 32.

The outer electrode 34 is so provided as to be set along the recess portion G4 of the flat plate core 20 and has a square U shape when viewed in the y-axis direction. A portion of the outer electrode 34 to be set along the recess G4*a* makes contact with a circuit board on which the coil component 1 is mounted. Further, the outer electrode 34 extends, from the portion thereof being set along the recess G4*a*, along the recess G4*b* in the z-axis direction and enters into the pot-type core 10 through the cutout C4 of the pot-type core 10 toward the positive side of the x-axis direction.

The outer electrode 35 is so provided as to be set along the recess portion G2 of the flat plate core 20 and has a square U shape when viewed in the y-axis direction. A portion of the outer electrode 35 to be set along the recess G2*a* makes contact with the circuit board on which the coil component 1 is mounted. Further, the outer electrode 35 extends, from the portion thereof being set along the recess G2*a*, along the recess G2*b* in the z-axis direction and enters into the pot-type core 10 through the cutout C2 of the pot-type core 10 toward the negative side of the x-axis direction.

The connection portion 37 is positioned inside the pot-type core 10 and connects one end at a lower portion of the winding section 32 and one end of the outer electrode 34 positioned on the positive side of the z-axis direction. Further, the connection portion 37 extends in the x-axis direction.

The connection portion 38 connects the other end at an upper portion of the winding section 32 and one end positioned at an upper portion of the outer electrode 35. More specifically, the connection portion 38 is formed of a horizontal segment 38*a* extending in the x-axis direction and a vertical segment 38*b* extending in the z-axis direction. One end of the horizontal segment 38*a* on the negative side of the x-axis direction is connected with one end at the upper portion of the winding section 32. Further, the other end of the horizontal segment 38*a* on the positive side of the x-axis direction is connected with one end at an upper portion of the vertical segment 38*b*. Furthermore, the other end at a lower portion of the vertical segment 38*b* is connected with the one end positioned at the upper portion of the outer electrode 35.

Figure 6:
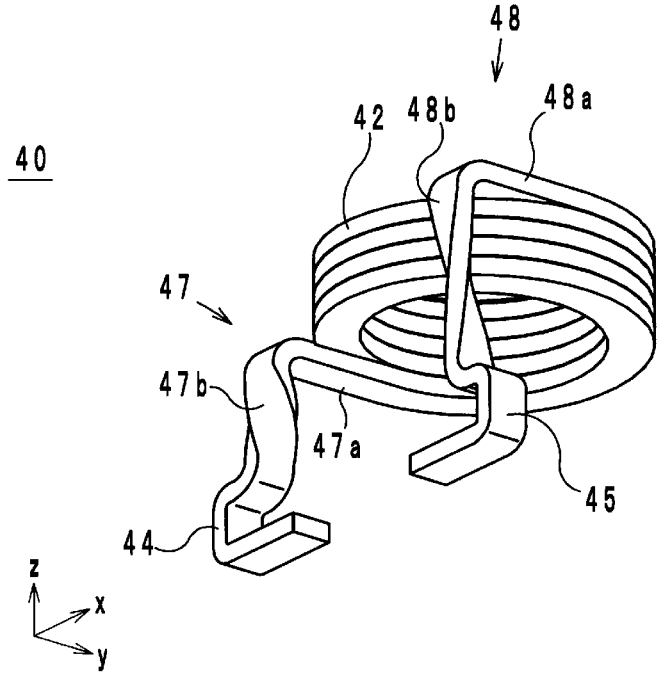
FIG. 6 is an exterior perspective view of another coil in the coil component according to the first embodiment.

The coil 40 (second coil) is positioned, as shown in FIG. 2, at an upper portion of the coil component 1, and configured of a winding section 42, outer electrodes 44 and 45, and connection portions 47 and 48, as shown in FIG. 6.

The winding section 42 is formed in a helical shape in a counterclockwise direction from an upper portion toward a lower portion thereof. In other words, the winding section 42 is wound in the same direction as the winding section 32. Note that the core 12 of the pot-type core 10 is accommodated at an inner circumference side of the winding section 42.

The outer electrode 44 is so provided as to be set along the recess portion G3 of the flat plate core 20 and has a square U shape when viewed in the y-axis direction. A portion of the outer electrode 44 to be set along the recess G3*a* makes contact with the circuit board on which the coil component 1 is mounted. Further, the outer electrode 44 extends, from the portion thereof being set along the recess G3*a*, along the recess G3*b* in the z-axis direction and enters into the pot-type core 10 through the cutout C3 of the pot-type core 10 toward the positive side of the x-axis direction.

The outer electrode 45 is so provided as to be set along the recess portion G1 of the flat plate core 20 and has a square U shape when viewed in the y-axis direction. A portion of the outer electrode 45 to be set along the recess G1*a* makes contact with the circuit board on which the coil component 1 is mounted. Further, the outer electrode 45 extends, from the portion thereof being set along the recess G1*a*, along the recess G1*b* in the z-axis direction and enters into the pot-type core 10 through the cutout C1 of the pot-type core 10 toward the negative side of the x-axis direction.

The connection portion 47 connects one end at a lower portion of the winding section 42 and one end positioned at an upper portion of the outer electrode 44. To be more specific, the connection portion 47 is formed of a horizontal segment 47*a* extending in the y-axis direction and a vertical segment 47*b* extending in the z-axis direction. One end of the horizontal segment 47*a* on the positive side of the y-axis direction is connected with the one end at the lower portion of the winding section 42. Further, the other end of the horizontal segment 47*a* on the negative side of the y-axis direction is connected with one end at an upper portion of the vertical segment 47*b*. Furthermore, the other end at a lower portion of the vertical segment 47*b* is connected with the one end positioned at the upper portion of the outer electrode 44. Here, the horizontal segment 47*a* of the connection portion 47 extends in the y-axis direction, while the outer electrode 44 enters into the pot-type core 10 through the cutout C3 of the pot-type core 10 toward the positive side of the x-axis direction. As such, the vertical segment 47*b* connecting the horizontal segment 47*a* and the outer electrode 44 is twisted so that the one end side thereof is turned toward the y-axis direction and the other end side thereof is turned toward the x-axis direction.

Inside the pot-type core 10, the connection portion 48 connects the other end at an upper portion of the winding section 42 and one end positioned at an upper portion of the outer electrode 45. More specifically, the connection portion 48 is formed of a horizontal segment 48*a* extending in the y-axis direction and a vertical segment 48*b* extending in the z-axis direction. One end of the horizontal segment 48*a* on the positive side of the y-axis direction is connected with the other end at the upper portion of the winding section 42. Further, the other end of the horizontal segment 48*a* on the negative side of the y-axis direction is connected with one end at an upper portion of the vertical segment 48*b*. Furthermore, the other end at a lower portion of the vertical segment 48*b* is connected with the one end of the outer electrode 45 positioned on the positive side of the z-axis direction. Here, the horizontal segment 48*a* of the connection portion 48 extends in the y-axis direction, while the outer electrode 45 enters into the pot-type core 10 through the cutout C1 of the pot-type core 10 toward the negative side of the x-axis direction. As such, the vertical segment 48*b* connecting the horizontal segment 48*a* and the outer electrode 45 is twisted so that the one end side thereof is turned toward the y-axis direction and the other end side thereof is turned toward the x-axis direction.

Configuration of Partition Core

The partition core 50 is a flat plate formed of magnetic material such as ferrite or the like, and is positioned, as shown in FIG. 2, between the coil 30 and the coil 40 inside the pot-type core 10. Further, the partition core 50 has a ring shape as a whole when viewed in the z-axis direction, where its inner circumference is substantially circular and its outer circumference is substantially octagonal. Moreover, the core 12 of the pot-type core 10 is accommodated at the inner side of the inner circumference of the partition core 50. Accordingly, the coil 30, the partition core 50, and the coil 40 are arranged in that order from the lower portion toward the upper portion while taking the core 12 of the pot-type core 10 as a central axis.

Function of Coil Component

The coil component 1 configured in the manner described above has functions as follows.

Figure 7:
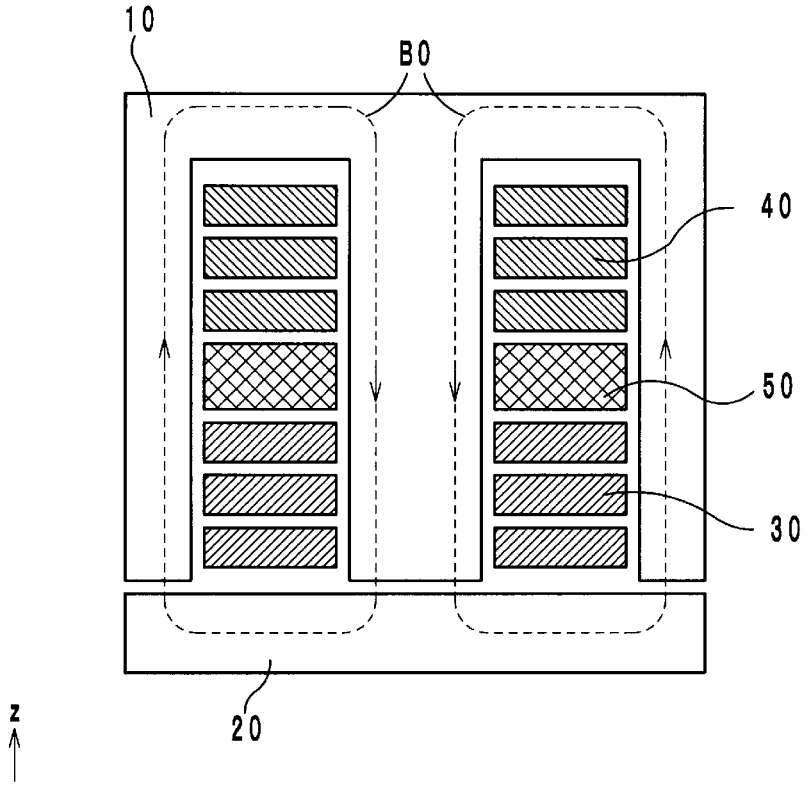
FIG. 7 is a cross-sectional view of the coil component according to the first embodiment.

In the coil component 1, because the coils 30 and 40 are provided so that the central axes thereof match each other, each magnetic flux B0 generated by the common mode current takes the same direction. Further, because the magnetic flux generated by the current flowing into the coil 30 passes through the coil 40, and the magnetic flux generated by the current flowing into the core 40 passes through the coil 30, as shown in FIG. 7, the magnetic fluxes generated in the coils 30 and 40 integrally strengthen each other whereby impedance against the common mode current is generated.

Figure 8:
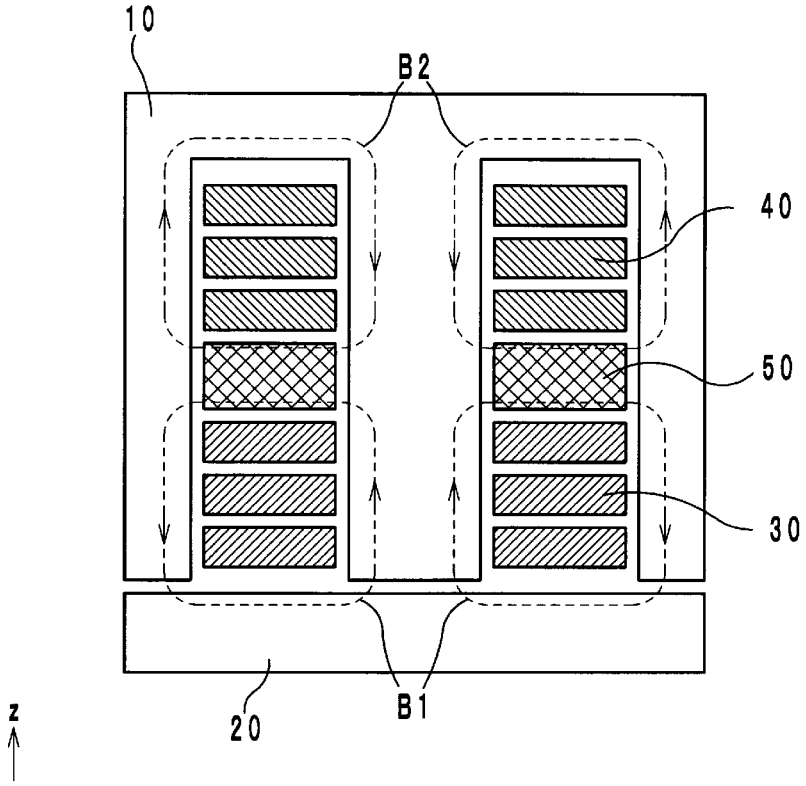
FIG. 8 is another cross-sectional view of the coil component according to the first embodiment.

In contrast, in the case where the normal mode current flows, magnetic flux B1 generated in the coil 30 and magnetic flux B2 generated in the coil 40 take opposite directions to each other. Here, it is to be noted that there is provided the partition core 50 formed of the magnetic body between the core and the core 40 in the coil component 1. This makes the partition core 50 form magnetic paths therein for the magnetic fluxes generated in the coil 30 and 40. As a result, a path of the magnetic flux B1 and a path of the magnetic flux B2 are isolated from each other, as shown in FIG. 8. With this, the magnetic fluxes will not cancel each other out, and impedance is also generated against the normal mode current in the coil component 1.

Effects

In the coil component 1, as discussed so far, in the case where the common mode AC current flows, the magnetic fluxes generated by the current flowing through the two coils 30 and 40 integrally strengthen each other so as to function as an inductor. Meanwhile, in the case where the normal mode AC current flows, paths of the magnetic flux B1 generated by the current flowing through the core 30 and the magnetic flux B2 generated by the current flowing through the core 40 are isolated from each other by the partition plate 50 formed of the magnetic substance that is provided between the two coils 30 and 40. With this, in the coil component 1, although the directions of the magnetic fluxes generated by the normal mode current flowing through the two coils are opposite to each other, the magnetic fluxes will not cancel each other out because the paths of the fluxes are isolated from each other. Accordingly, the coil component 1 also functions as an inductor against the normal mode AC current.

The partition core 50 of the coil component 1 has a ring shape as a whole where its inner circumference is substantially circular and its outer circumference is substantially octagonal when viewed in the z-axis direction. In other words, the partition core 50 has a rotationally symmetric shape while taking an axis parallel to the z-axis direction as a central axis. This makes it unnecessary to specify a mounting orientation of the partition core 50 in a production process in which the partition core 50 is inserted in the pot-type core 10. Because of this, a worker in the production process can insert the partition core 50 in the pot-type core without being worried about the mounting orientation of the partition core 50, thereby achieving preferable productivity of the coil component 1.

In the common mode filter disclosed in Japanese Unexamined Patent Application Publication No. 2003-243228, two helical coils positioned inside the pot-type core are wound so that the central axes thereof match each other, and conductive wires configuring the respective coils are so provided as to be alternately laminated on each other. As such, because the conductive wires configuring the two helical coils are close to each other across the overall region from an upper portion down to a lower portion of the coils, short circuits are likely to be generated between the above-mentioned conductive wires. However, of the coils 30 and 40 in the coil component 1, the coil 30 is disposed in the upper portion and the coil 40 is disposed in the lower portion inside the pot-type core 10. In other words, in the coil component 1, the coils 30 and 40 are separately disposed in the upper and lower portions, respectively. Because of this, in the coil component 1, the conductive wires configuring the coils 30 and 40 will not be close to each other across the overall region from the upper portion down to the lower portion of the coils 30 and 40. As such, short circuits are unlikely to be generated between the conductive wires in the coil component 1 in comparison with the common mode filter disclosed in Japanese Unexamined Patent Application Publication No. 2003-243228.

In addition, the partition core 50 is provided between the coil 30 and the coil 40 in the coil components 1. This suppresses a short circuit between a conductive wire at the lowest portion of the coil 30 and a conductive wire at the uppermost portion of the coil 40.

Furthermore, the coil 40 of the coil component 1 is positioned in the upper portion of the coil component 1, and consequently the connection portions 47 and 48 are connected to the outer electrodes 44 and 45, respectively, striding over the coil 30. Note that the vertical segments 47*b* and 48*b* of the connection portions 47 and 48 are respectively so twisted as to connect the winding section 42 to the outer electrodes 44 and 45. However, since the vertical segments 47*b* and 48*b* are respectively connected to the outer electrodes 44 and 45 while striding over the coil 30, lengths thereof are sufficiently long. As such, in the coil component 1, although the connection portions 47 and 48 are twisted, excessive twisting stress is suppressed from being applied to the connection portions 47 and because the connection portions 47 and 48 have sufficient lengths with respect to the amount of twisting.

First Variation

A coil component 1A according to a variation differs from the coil component 1 in that the material of the partition core 50 is a resin containing metal magnetic powder. Because a saturation magnetic flux density of a metal magnetic body is generally higher than that of a ferrite, a resin containing metal magnetic powder is unlikely to undergo magnetic saturation. As such, in the coil component 1A, magnetic saturation is unlikely to occur in the partition core 50 serving as paths of the magnetic flux generated in the coils 30 and 40, and the direct-current (DC) superposition characteristics are improved compared to the coil component 1. Other constituent elements of the coil component 1A are the same as those of the coil component 1. Accordingly, descriptions of the coil component 1A are the same as those of the coil component 1 aside from the description of the partition core 50.

Second Variation

Figure 9:
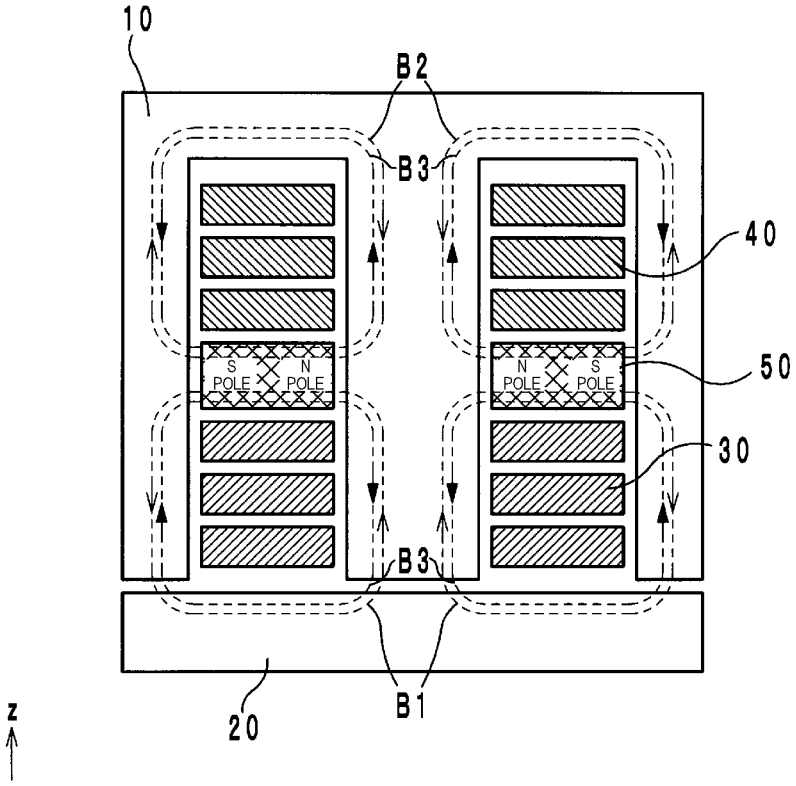
FIG. 9 is also a cross-sectional view of the coil component according to the first embodiment.

A coil component 1B according to a second variation differs from the coil component 1 in that the partition core 50 is magnetized in a direction from the inner circumference side toward the outer circumference side, as shown in FIG. 9. In other words, the partition core 50 is magnetized so that magnetic flux B3 is generated in a direction opposite to a direction of the magnetic flux generated in the coils 30 and 40 by the normal mode current. With this, in the coil components 1B, because part of the magnetic flux generated in the coils 30 and 40 is canceled out, the DC superposition characteristics are improved. Other constituent elements of the coil component 1B are the same as those of the coil component 1. Accordingly, descriptions of the coil component 1B are the same as those of the coil component 1 aside from the description of the partition core 50.

Third Variation

Figure 10:
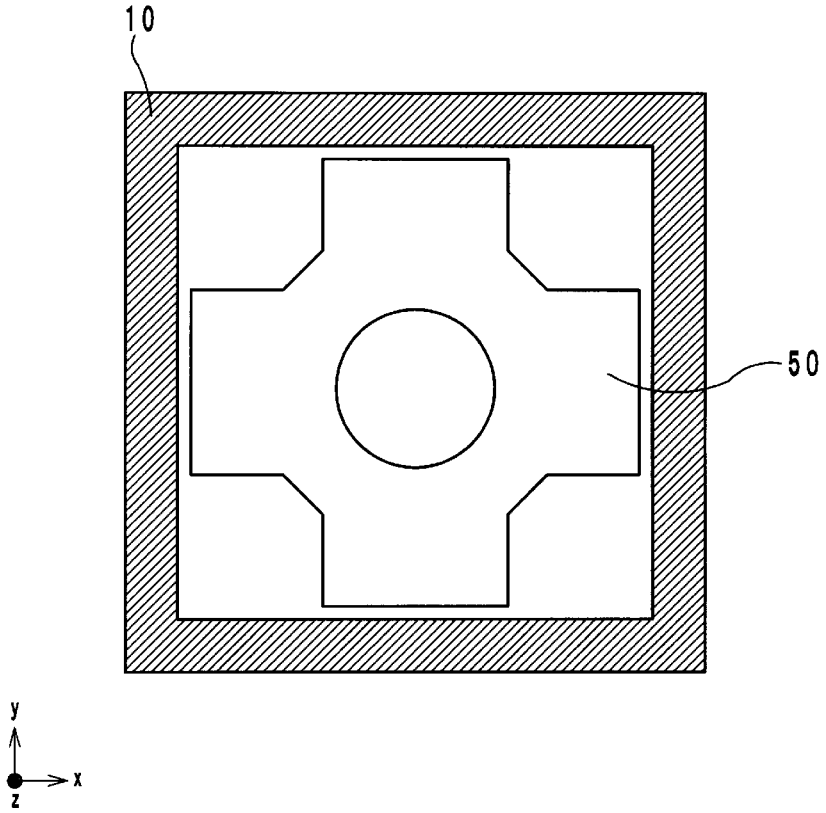
FIG. 10 is a plan view of a partition core in a coil component according to a variation.

A coil component 1C according to a third variation differs from the coil component 1 in that an outer circumference of the partition core 50 is formed substantially in a cross shape when viewed from the positive side of the z-axis direction, as shown in FIG. 10. In other words, the partition core 50 of the coil component 1C has a rotationally symmetric shape while taking an axis parallel to the z-axis direction as a central axis. This makes it unnecessary to specify a mounting orientation of the partition core 50 in a production process in which the partition core 50 is inserted in the pot-type core 10. Because of this, a worker in the production process can insert the partition core 50 in the pot-type core without being worried about the mounting orientation of the partition core 50, thereby achieving preferable productivity of the coil component 1C. Other constituent elements of the coil component 1C are the same as those of the coil component 1. Accordingly, descriptions of the coil component 1C are the same as those of the coil component 1 aside from the description of the partition core 50.

Fourth Variation

Figure 11:
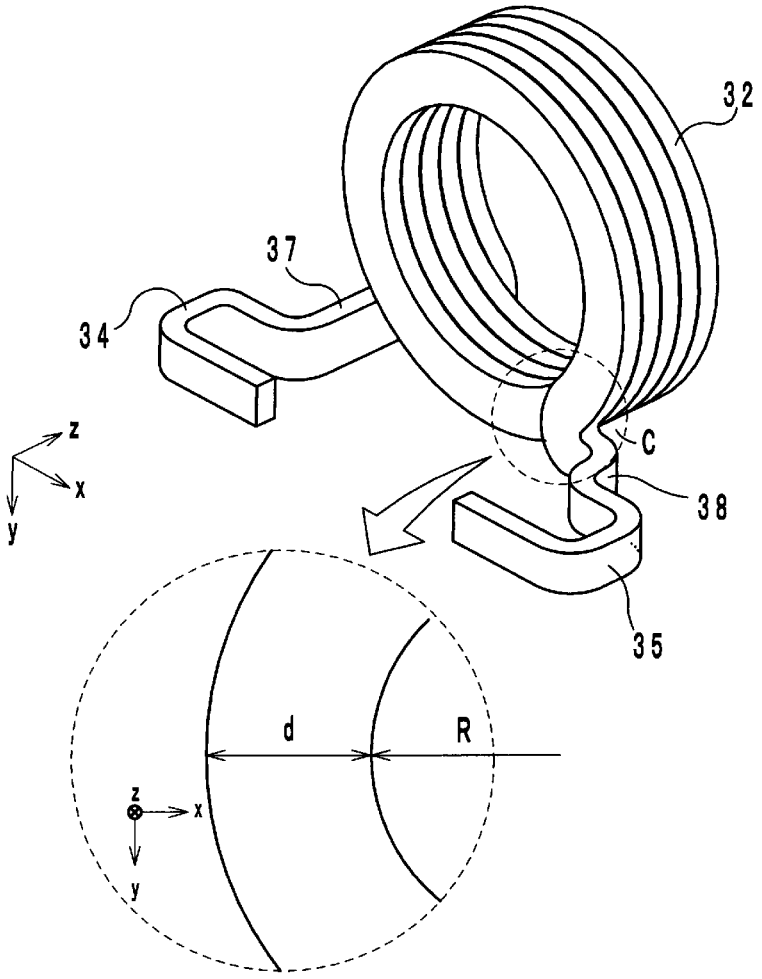
FIG. 11 is an exterior perspective view of a coil in a coil component according to another variation.

As shown in FIG. 11, a coil component 1D according to a fourth variation differs from the coil component 1 in that the shapes of the winding section 32 and the connection portions 37, 38 of the coil component 1D are different from those of the coil component 1.

The winding section 32 is formed in a helical shape that is wound counterclockwise extending from an upper portion toward a lower portion thereof.

The connection portion 37 connects one end at the upper portion of the winding section 32 and one end of the outer electrode 34 positioned on the positive side of the z-axis direction.

The connection portion 38 connects the other end at the lower portion of the winding section 32 and one end positioned at an upper portion of the outer electrode 35. Further, the connection portion 38, excluding both ends thereof, extends in the z-axis direction. To be more specific, in order for the connection portion 38 to be connected with the winding section at a connecting part C to the winding section 32 that is positioned at an upper portion of the connection portion 38, the connection portion 38 is bent from the z-axis direction side toward the x-axis direction side, and then further bent along a plane parallel to the x-axis direction and the y-axis direction. Here, a curvature radius R along the plane parallel to the x-axis and y-axis directions at the connecting part C is larger in dimension than a width "d" of a conductive wire configuring the coil 30 (length in a longer side direction of the rectangular cross section). With this, the conductive wire configuring the coil 30 is suppressed from being excessively bent, thereby reducing stress applied to the outer circumference of the conductive wire. Other constituent elements of the coil component 1D are the same as those of the coil component 1. Accordingly, descriptions of the coil component 1D are the same as those of the coil component 1 aside from the description of the coil 30.

Second Embodiment

Figure 12:
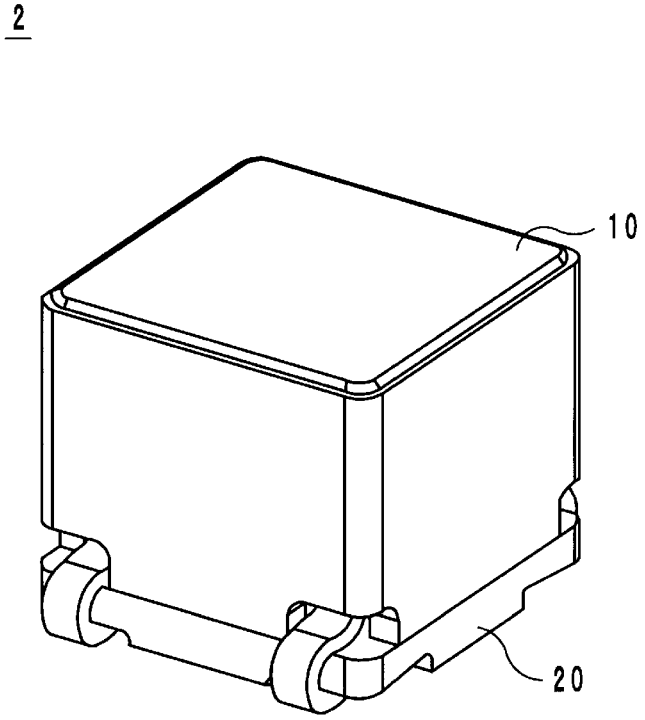
FIG. 12 is an exterior perspective view of a coil component according to a second embodiment.

A coil component 2 according to a second embodiment shown in FIG. 12 differs from the coil component 1 according to the first embodiment in that the shapes of the pot-type core 10, the flat plate core 20, and the partition core 50 are different from those of the coil component 1. This will be specifically described below.

Figure 13:
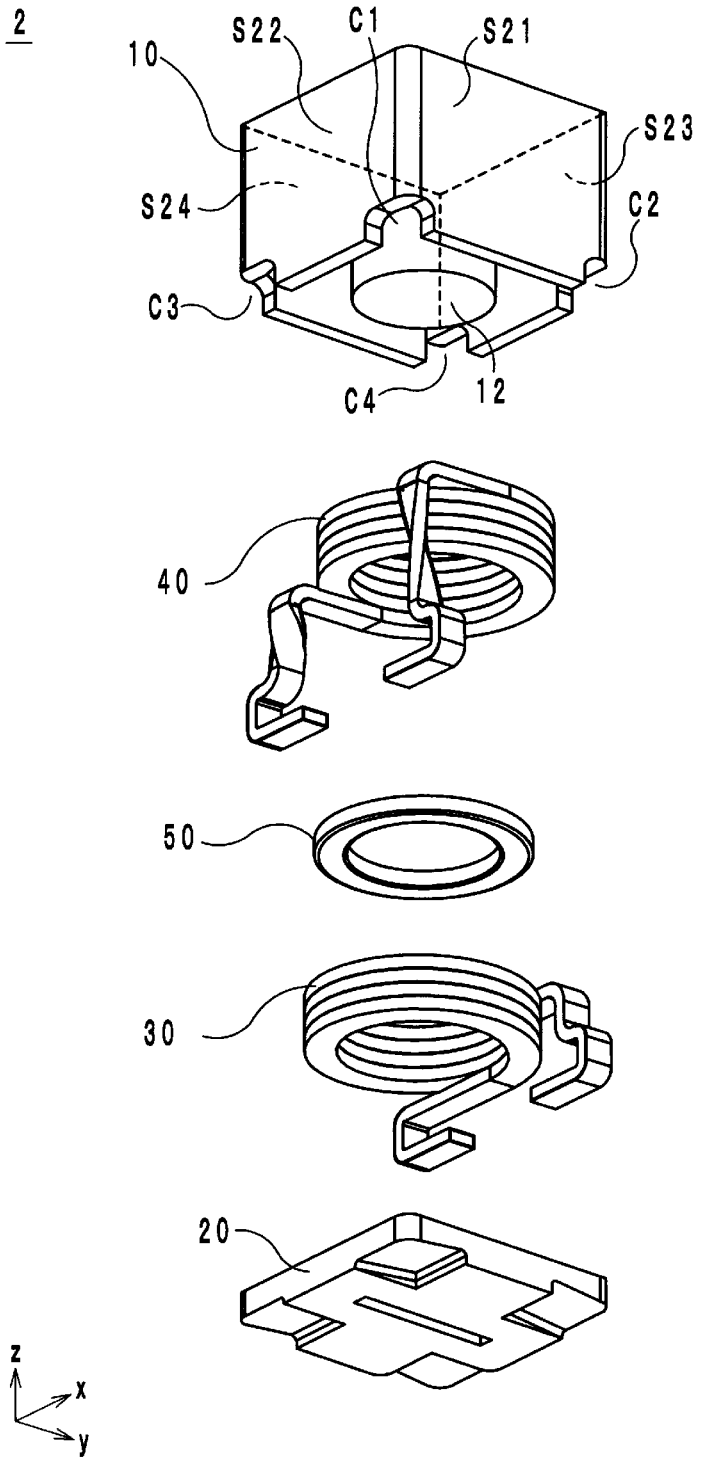
FIG. 13 is an exploded perspective view of the coil component according to the second embodiment.

In the coil component 2, as shown in FIG. 13, the cutout C1 is provided in a corner portion formed by a side surface S21 on the positive side of the x-axis direction and a side surface S22 on the negative side of the y-axis direction of the pot-type core 10. Further, the cutout C2 is provided in a corner portion formed by the side surface S21 and a side surface S23 on the positive side of the y-axis direction of the pot-type core 10. Furthermore, the cutout C3 is provided in a corner portion formed by a side surface S24 on the negative side of the x-axis direction and the side surface S22 of the pot-type core 10. Then, the cutout C4 is provided in a corner portion formed by the side surface S23 and the side surface S24.

Figure 14:
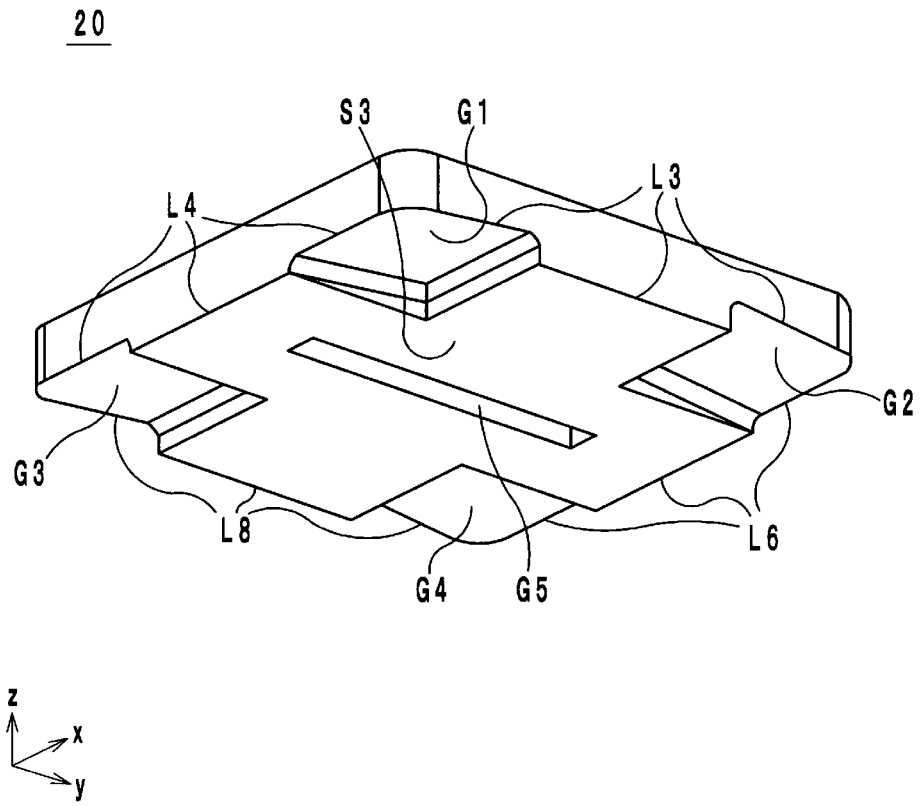
FIG. 14 is an exterior perspective view of a flat plate core in the coil component according to the second embodiment.

As shown in FIG. 14, the recess portions G1 through G4 provided on the surface S3 of the flat plate core 20 are substantially formed in a square shape when viewed in the z-axis direction. In this case, a side of the recess portion G1 on the positive side of the x-axis direction configures part of the side L3 as an edge of the flat plate core 20, and a side of the recess portion G1 on the negative side of the y-axis direction configures part of the side L4 as an edge of the flat plate core 20. Further, a side of the recess portion G2 on the positive side of the x-axis direction configures part of the side L3 as an edge of the flat plate core 20, and a side of the recess portion G2 on the positive side of the y-axis direction configures part of the side L6 as an edge of the flat plate core 20. Furthermore, a side of the recess portion G3 on the negative side of the x-axis direction configures part of the side L8 as an edge of the flat plate core 20, and a side of the recess portion G3 on the negative side of the y-axis direction configures part of the side L4 as an edge of the flat plate core 20. Then, a side of the recess portion G4 on the negative side of the x-axis direction configures part of the side L8 as an edge of the flat plate core 20, and a side of the recess portion G4 on the positive side of the y-axis direction configures part of the side L6 as an edge of the flat plate core 20. Note that a depth of each of the recess portions G1 through G4 becomes deeper as it progresses from the edge side of the flat plate core 20 toward the inner side of the flat plate core 20. Moreover, a linear groove G5 is provided in the surface S3 of the flat plate 20 in parallel to the y-axis direction.

In the coil component 2, both an inner circumferential shape and an outer circumferential shape of the partition core are substantially circular when viewed in the z-axis direction, as shown in FIG. 13.

In the flat plate core 20 of the coil component 2 configured as described above, a crack, breakage, or the like is unlikely to be generated in comparison with the flat plate core of the coil component 1. To be more specific, the recess portions G1 through G4 of the coil component 1 are provided in parallel to the edges extending in the x-axis direction, as shown in FIGS. 3 and 4, and provided in the vicinity of each corner of the flat plate core 20. As such, elongate projections P1 through P4 are respectively formed in parallel to the x-axis direction at the portions being sandwiched between the edge of the flat plate core 20 and the recess portions G1 through G4. Because of the projections P1 through P4 being formed in an elongate shape, there is a risk that a crack, breakage, or the like is generated therein at the time of press-molding the flat plate core 20, mounting the coil component 1, and so on. On the other hand, the recess portions G1 through G4 of the coil component 2 according to the second embodiment are each formed in the overall corner portion, as shown in FIG. 14. Accordingly, unlike the coil component 1 of the first embodiment, an elongate projection is not formed in the flat plate core 20 of the coil component 2. As such, a crack, breakage, or the like is unlikely to be generated in the flat plate core 20 of the coil component in comparison with the flat plate core 20 of the coil component 1.

Figure 15:
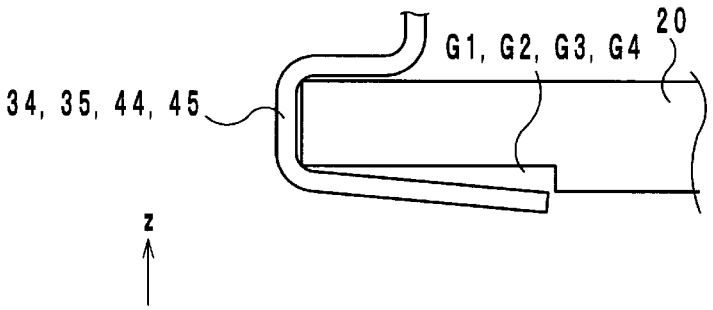
FIG. 15 is a cross-sectional view of the vicinity of an outer electrode in the coil component according to the first embodiment.
Figure 16:
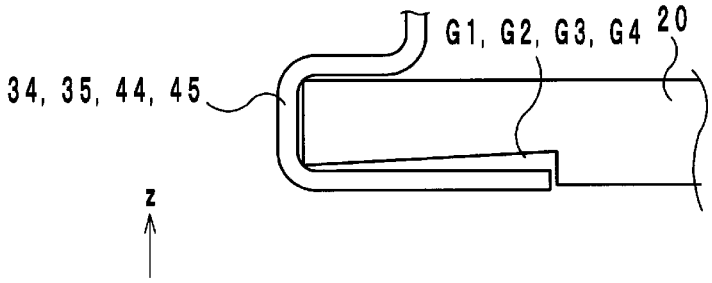
FIG. 16 is a cross-sectional view of the vicinity of an outer electrode in the coil component according to the second embodiment.

In addition, the outer electrodes 34, 35, 44, and 45 of the coil component 2 can be connected to a circuit board more surely than those of the coil component 1. To be more specific, as discussed in the first embodiment, the outer electrodes 34, 35, 44, and 45 are provided along the recess portions G1 through G4, and have a square U shape when viewed in the y-axis direction. Note that, however, a cavity of the stated square U shape is easily widened due to spring-back, as shown in FIG. 15. As such, at the time of mounting the coil component 1, there is a risk that most parts of the mounting surfaces of the outer electrodes 34, 35, 44, and 45 can float up from the circuit board. Meanwhile, in the coil component 2, the depth of each of the recess portions G1 through G4 of the flat plate core 20 becomes deeper as it progresses from the edge side of the flat plate core 20 toward the inner side of the flat plate core 20. With this, the end portions of the outer electrodes 34, 35, 44, and 45 provided along the recess portions G1 through G4 are bent toward the positive side of the z-axis direction. Accordingly, even if the cavity of the square U shape, which the outer electrodes 34, 35, 44, and 55 each include, is widened, each mounting surface of the outer electrodes 34, 35, 44, and 45 of the coil component 2 can be suppressed from floating up from the circuit board, as shown in FIG. 16. In other words, the outer electrodes 34, 35, 44, and 45 of the coil component 2 can be connected to the circuit board more surely than those of the coil component 1.

Moreover, in the coil component 2, because the linear groove G5 is provided in the surface S3 of the flat plate 20 in parallel to the y-axis direction, an orientation of the flat plate core 20 can be recognized when the flat plate core 20 is mounted in the pot-type core 10. Likewise, at the time of mounting the coil component 2, the orientation of the component can be recognized from the groove G5. Other constituent elements of the coil component 2 are the same as those of the coil component 1. Accordingly, descriptions of the coil component 2 are the same as those of the coil component 1 aside from the description of the shapes of the pot-type core 10, the flat plate core 20, and the partition coil 50.

Other Embodiments

Figure 17:
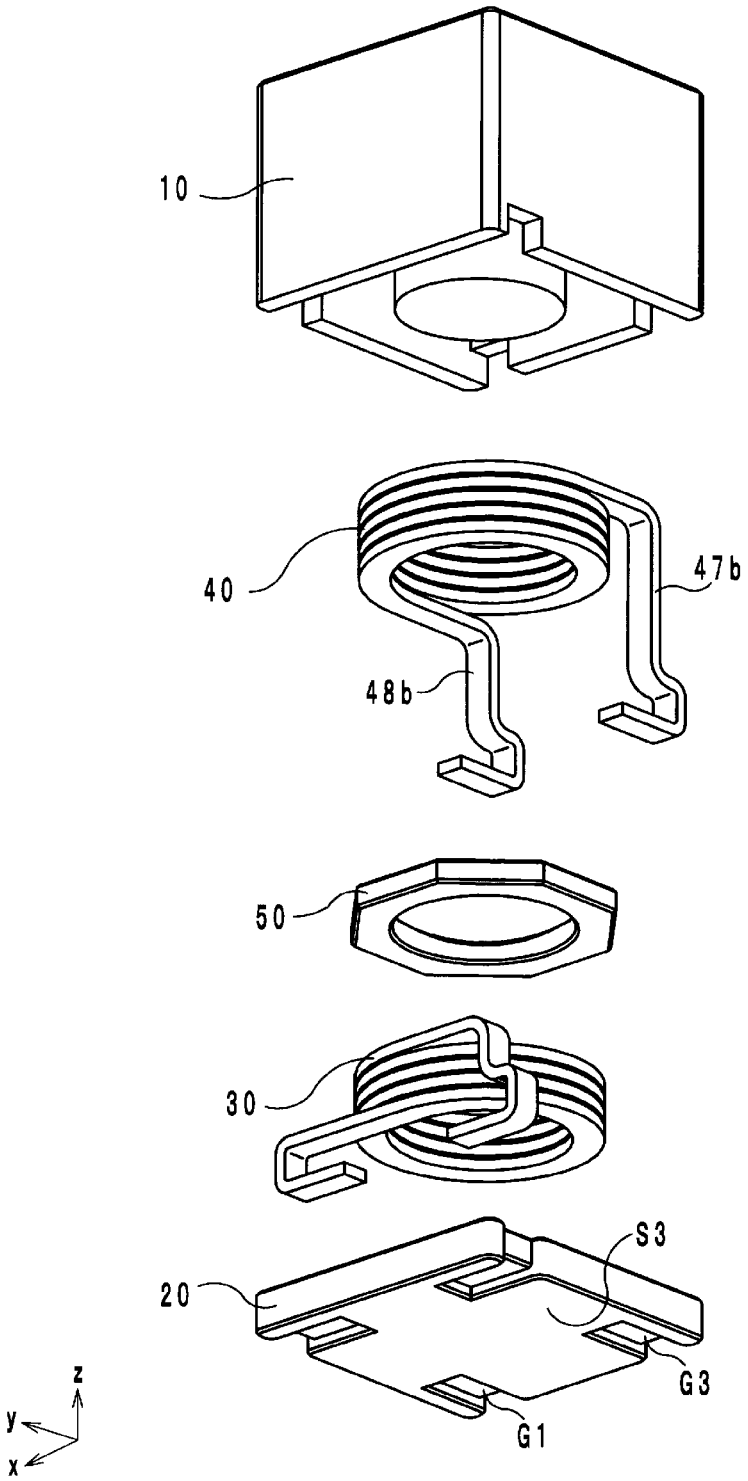
FIG. 17 is an exploded perspective view of a coil component according to another embodiment.

The coil components according to the present disclosure are not limited to the above embodiments, and various kinds of modifications can be made without departing from the range of the spirit of the disclosure. For example, the first variation and the fourth variation may be combined. Further, as shown in FIG. 17, the vertical segments 47*b* and 48*b* of the connection portions 47 and 48 in the coil 40 may be linearly shaped. Corresponding to this, the recess portions G1 and G3 of the flat plate core 20 may be provided across the surface S3 of the flat plate core 20 and a surface on the negative side of the y-axis direction.

INDUSTRIAL APPLICABILITY

As discussed thus far, the present disclosure is excellent in that the coil component including two or more coils configuring a common mode choke coil is capable of functioning as an inductor against a normal mode AC current.

The invention claimed is:

1. A coil component comprising:

a box-like structure configured of a box-type core having a predetermined side forming an opening portion and a flat plate core sealing the opening portion, and four cutouts are provided in edges on the opening portion side of side surfaces adjacent to the predetermined side;

a first coil provided inside the structure;

a second coil provided inside the structure at a position on one side relative to the first coil; and a partition plate formed of a magnetic substance that is provided between the first coil and the second coil, wherein the first coil and the second coil form a common mode choke coil by making a central axis of the first coil and a central axis of the second coil substantially match each other when viewed in a direction along the central axes of the first and second coils, each of end portions of the first coil and end portions of the second coil functions as outer electrodes, and the end portions of the first coil and the end portions of the second coil are extended, through the cutouts, to a mounting surface of the flat plate core which is one of outer surfaces of the box-like structure.

2. The coil component according to claim 1, wherein a cross section of a conductive wire configuring the second coil has a rectangle shape.

3. The coil component according to claim 1, wherein connection portions that connect a winding section of the second coil to the end portions of the second coil are twisted.

4. The coil component according to claim 1, wherein the four cutouts are each provided in one of the side surfaces adjacent to the predetermined side.

5. The coil component according to claim 1, wherein the four cutouts are each provided in a corner formed by two of the side surfaces adjacent to the predetermined side.

6. The coil component according to claim 1, wherein recess portions are provided in the mounting surface of the flat plate core, and the end portions of the first coil and the end portions of the second coil are positioned in the recess portions.

7. The coil component according to claim 6, wherein the recess portions are formed in a rectangle shape when viewed in a direction orthogonal to the mounting surface, and only one side of the rectangle shape configures part of an edge of the flat plate core when viewed in the direction orthogonal to the mounting surface.

8. The coil component according to claim 6, wherein the recess portions are formed in a rectangle shape when viewed in a direction orthogonal to the mounting surface, and each of two sides of the rectangle shape is part of edges of the flat plate core when viewed in the direction orthogonal to the mounting surface.

9. The coil component according to claim 6, wherein a depth of the recess portions becomes deeper progressing from an edge side of the flat plate core to an inner side of the flat plate core.

10. The coil component according to claim 1, wherein the partition plate has a rotationally symmetric shape when viewed in the direction along the central axis of the first coil.

11. The coil component according to claim 10,
wherein the partition plate is formed in a cross shape when viewed in the direction along the central axis.

12. The coil component according to claim 10,
wherein the partition plate is formed in an octagon shape when viewed in the direction along the central axis.

13. The coil component according to claim 1,
wherein a material of the partition plate is a resin containing magnetic metal powder.

14. The coil component according to claim 1,
wherein the partition plate is formed of a permanent magnet, and
a magnetization direction of the permanent magnet is opposite to a direction of magnetic flux that is generated in the first coil and passes through the permanent magnet.

15. The coil component according to claim 1,
wherein a groove used for orientation recognition is provided in the mounting surface.

* * * * *